United States Patent [19]

Fujii et al.

[11] Patent Number: 4,919,795

[45] Date of Patent: Apr. 24, 1990

[54] LEAKAGE PREVENTION APPARATUS FOR A CLASSIFIER

[75] Inventors: Satoru Fujii, Onoda; Hiroaki Tanaka, Funabashi; Takeshi Furukawa; Masaaki Muraoka, both of Onoda; Ryosuke Narishima, Kawasaki; Takamiki Tamashige, Tokyo, all of Japan

[73] Assignee: Onoda Cement Company, Ltd., Japan

[21] Appl. No.: 297,552

[22] Filed: Jan. 13, 1989

[30] Foreign Application Priority Data

Jan. 18, 1988 [JP] Japan ..... 63-6776
May 19, 1988 [JP] Japan ..... 63-120617

[51] Int. Cl.[5] ..... B07B 4/02; B07B 7/00

[52] U.S. Cl. ..... 209/135; 55/406; 209/139.2; 209/144; 209/154; 277/25; 277/53

[58] Field of Search ..... 209/134, 135, 139.2, 209/148, 143, 145, 154, 144; 55/406; 277/25, 53, 57, 67, 68

[56] References Cited

U.S. PATENT DOCUMENTS 3,670,886 6/1972 Hosokawa et al. ..... 209/148 X
4,257,880 3/1981 Jones ..... 209/144
4,296,864 10/1981 Misaka et al ..... 209/148 X
4,390,419 6/1983 Barthelmess ..... 209/144 X
4,818,376 4/1989 Tanaka et al. ..... 209/154 X

FOREIGN PATENT DOCUMENTS 704468 2/1941 Fed. Rep. of Germany ..... 209/144

*Primary Examiner*—Donald T. Hajec

[57] ABSTRACT

In a classifier having a rotary classifying impeller in a casing for discharging fine powder to the outside of the casing, a leakage prevention apparatus is provided for the classifier which has a rotary seal member mounted on the upper plate of the rotary classifying impeller at the boundary portion between the rotary classifying impeller and a fine powder discharge duct. The upper portion of the rotary seal member protrudes outwardly from an opening in the top plate of the casing to separate the reduced air pressure in the discharge duct perfectly from the high pressure in the raw material dispersion chamber which is radially outside of the seal member. Furthermore, the rotary seal member can be provided with a circular groove in a J-shaped sectional structure. The end portion of this rotary seal member can also be formed into a square shape, a rounded shape or an inclined acute shape.

7 Claims, 2 Drawing Sheets

LEAKAGE PREVENTION APPARATUS FOR A CLASSIFIER

BACKGROUND OF THE INVENTION

This invention relates to an apparatus for preventing leakage of a portion of a coarse powder into a fine powder discharge duct of a classifier.

It is well known for a classifier to have a rotary classifying impeller in a machine housing or casing in which an introduced raw material is classified into a coarse portion being discharged below and a fine portion, being made to flow through the classifying impeller together with an air flow.

However, in such prior classifiers, there can be gaps at the boundary portions between the rotating classifying impeller and a fixed end of the fine powder discharge duct, and thus the coarse particles can leak into the fine powder discharge duct through such gaps.

Therefore, in order to prevent leakage of the coarse powder through the gaps at the boundary portion between the classifying impeller and the fine powder discharge duct, in the prior art a labyrinth mechanism and a mechanical seal were provided at those gaps, or means for blowing seal gas by is provided. However, none of such attempts can perfectly prevent the leakage.

Although the pressure difference between the outside and the inside of the labyrinth is reduced as a result of the repeated expansion and compression through the labyrinth, this is not a perfect seal structure, because there still remains such problems as powder piling up in the labyrinth. As for mechanical seals, contact sliding portions between the rotary side and the stationary side are easily worn, due to powder abrasion. In addition, the complicated mechanism thereof consequently increases the production costs. With sealing gas, the leakage of coarse particles from the classifier will be perfectly prevented. However, an excess or a shortage of the blowing volume of the seal gas will easily influence performance and running costs. In addition, this measure requires a supplemental air-supply installation, increasing initial investiment.

SUMMARY OF THE INVENTION

Therefore, an object of this invention is to provide a leakage prevention apparatus for a classifier in order to resolve the above-mentioned problems left unsolved in the prior art. This apparatus comprises a rotary seal member provided on an upper plate of a rotary classifying impeller. The rotating circular seal member protrudes outwardly from an opening of a top plate of a casing.

Another object of the invention is to provide a leakage prevention apparatus for a classifier in order to improve the performance of the above-mentioned apparatus. This apparatus includes a rotary seal member having a circular groove provided on the upper plate of the rotary classifying impeller at the boundary portion between the fine powder discharge duct and the rotary classifying impeller.

According to a first embodiment of the invention in order to establish the above first object of the invention in a classifier of a type having a rotary classifying impeller in a casing for flowing and passing selected fine powder with an air flow into the rotary classifying impeller to discharge said fine powder to the outside of the casing, a leakage prevention apparatus for a classifier is provided in which a rotary seal member is mounted on an upper plate of the rotary classifying impeller located at the boundary portion between the rotary classifying impeller and the fine powder discharge duct, the upper portion of a so-called rotary seal member protruding outwardly from an opening of a top plate.

Thus, by the above-mentioned leakage prevention apparatus the present invention can prevent the leakage of powder from the radially outer portion of the raw material classifying chamber into the fine powder discharge duct side.

Furthermore, by another embodiment of the leakage prevention apparatus of the present invention the leakage of the powder from the radially outer portion of the raw material classifying chamber into the fine powder discharge duct side can be prevented by forming the rotary seal member with a circular groove. By forming this seal member in a J-shaped sectional construction the force from the outside of the casing into the discharge duct side is increased without affecting the centrifugal force working on the classified fine powder, not only eliminating the shooting out of fine powder from the casing, but also preventing the leakage of coarse powder into the fine powder discharges duct. Furthermore, the piling up of the fine powder in the groove of the rotary seal member is eliminated by means of a rinsing by the air flow adjusted carefully directed from the atmosphere to the fine powder discharge duct through the groove.

Other objects, features and advantages of the invention will be clearly described in the following detailed explanation with reference to the attached drawings for the specific embodiments of the invention in which the same or similar members use the same numerals.

DESCRIPTION OF THE DRAWINGS

The invention will be explained in conjunction with the illustrative embodiments shown in the accompanying drawings, in which.

DESCRIPTION OF PREFERRED EMBODIMENTS OF THE INVENTION

Figure 1:
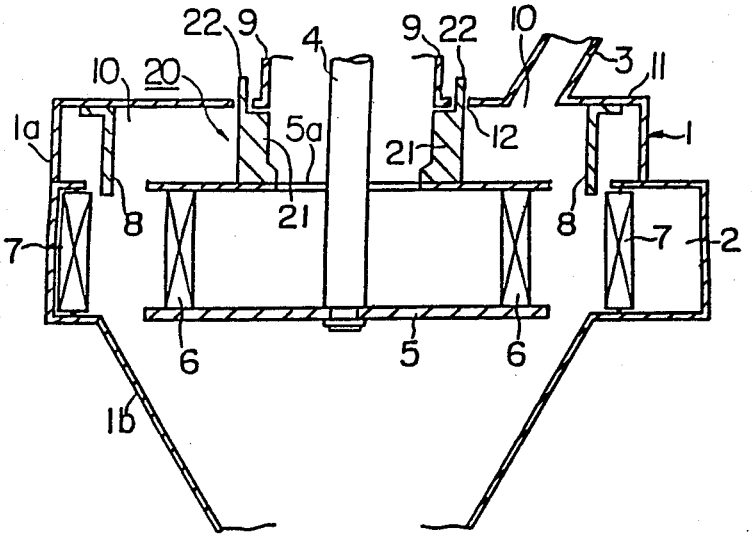
FIG. 1 is a vertical section of the first embodiment of a leakage prevention apparatus for a classifier formed in accordance with the invention.
Figure 2:
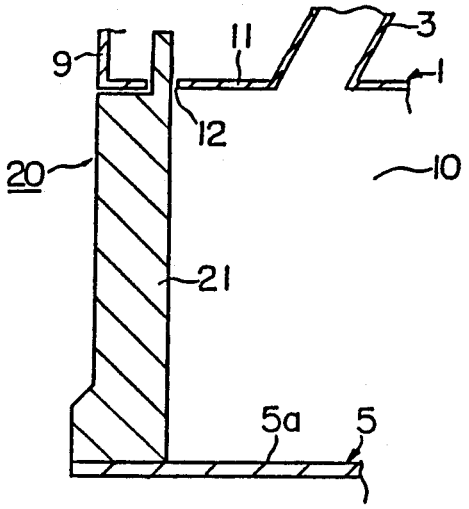
FIG. 2 is a partially enlarged section of the leakage prevention apparatus in FIG. 1.

Referring in detail to the figures in the drawings, there is shown diagrammatically in FIGS. 1 and 2 an embodiment of a classifier with a leakage prevention apparatus of the invention having a hopper-type casing 1 with a substantially cylindrical upper portion 1*a* and a substantially cone-shaped lower portion 1*b* which is provided with a tangential air inlet 2 on the cylindrical side portion 1*a* of the casing 1, a raw material inlet 3 on the top plate 11 of the casing 1 and a vertical rotary shaft 4 at the center of the casing 1. On the lower end of the rotary shaft 4 a rotor or a rotary classifying impeller 5 having a plurality of classifying vanes 6 is provided. A plurality of vertical stationary guide vanes 7 are disposed between the cylindrical inner wall of the casing 1 and the rotary classifying impeller 5 along a circle concentric with the rotary shaft 4 at a certain angle, and a circular collision plate 8 is provided at the inner side of the casing 1 around a raw material dispersion chamber 10 above an upper plate 5*a* of the rotary classifying impeller 5 coaxially with the rotary shaft 4. Furthermore, a fine powder discharge duct 9 is provided at the top center of the casing 1 around the rotary shaft 4 for discharging the classified fine powder.

For such a classifier, a leakage prevention apparatus 20 in accordance with the present invention is provided at the boundary portion between the rotary classifying impeller 5 and the fine powder discharge duct 9. That is, as shown in FIGS. 1 and 2, the leakage prevention apparatus 20 comprises a circular rotary seal member 21 secured on the upper plate 5*a* of the rotary classifying impeller 5 at the boundary portion between the upper plate 5*a* of the rotary classifying impeller 5 and the end portion of the fine powder discharge duct 9 in which the upper portion 22 of the rotary seal member 21 protrudes outwardly from a circular opening 12 on a top plate 11 of the casing 1 to separate the fine powder discharge duct 9 and the raw material dispersion chamber 10. The upper portion 22 of the rotary seal member 21 appropriately protrudes slightly from the top plate 11 of the casing 1, and the gap between the upper portion 22 of the rotary seal member 21 and the opening 12 of the top plate 11 is also determined appropriately.

Figure 3:
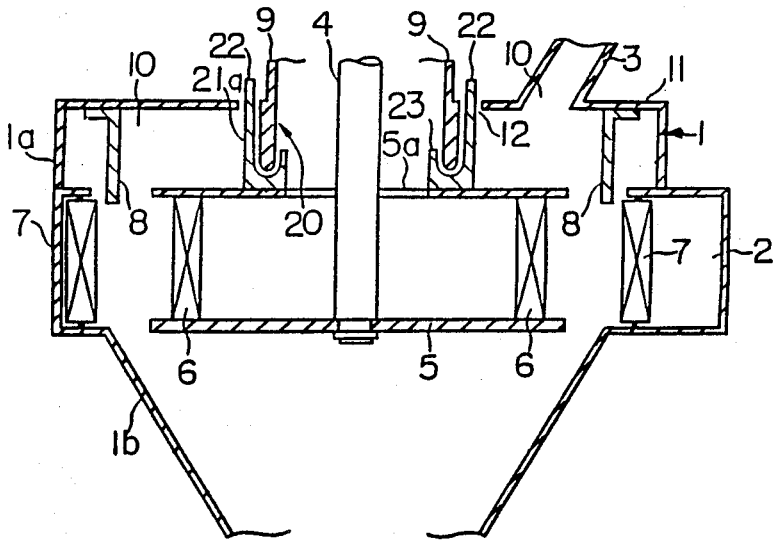
FIG. 3 is a vertical section of the second embodiment of the leakage prevention apparatus for a classifier.
Figure 4:
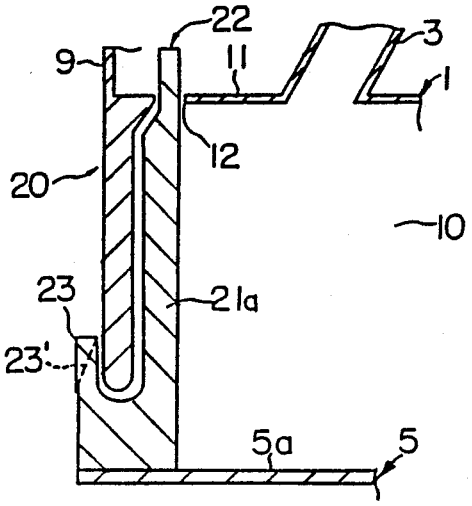
FIG. 4 is a partially enlarged section of the leakage prevention apparatus in FIG. 3.

In FIGS. 3 and 4 there is shown the second embodiment of the classifier having the leakage prevention apparatus of the present invention, in which the leakage prevention apparatus 20 comprises a circular seal member 21*a* secured on the upper plate 5*a* of the rotary classifying impeller 5 at the boundary portion between the upper plate 5*a* of the rotary classifying impeller 5 and the discharge duct 9 for the fine powder, the upper portion 22 of the rotary seal member 21*a* protruding outwardly from the circular opening 12 on the top plate 11 of the casing 1 to separate the discharge duct 9 and the raw material dispersion chamber 10. This seal member 21*a* is formed into a circular structure having a groove. Namely, the seal member 21*a* is formed into a J-shaped sectional structure to wrap the lower end of the discharge duct 9 to a length of about one-fifth of the distance between the top plate 11 of the casing 1 and the upper plate 5*a* of the impeller 5. The end portion 23 of the J-shaped structure can be formed with rounded or squared edges, but it is particularly desirable to form it with an inclined acute edge as shown by 23'. Such an inclined acute edge 23' prevents air turbulance, and thus, makes it easy for the fine powder to be discharged together with the air flow.

With such an arrangement of the classifier provided with the leakage prevention apparatus 20 of the present invention, the raw material is first charged from the material inlet 3, and the classifying air is supplied from the air inlet 2 to form a vortex through the stationary guide vanes 7 and the classifying vanes 6 of the rotary classifying impeller 5. The raw material which falls on the upper plate 5*a* of the rotary classifying impeller 5, is dispersed by the rotation of the rotary classifying impeller 5 to collide with and be dispersed by the collision plate 8 and is flows into the classifying air vortex. The raw material particles flow with and are acted upon by the classifying air. The centrifugal force resulting from the rotation of the vortex exceeding the drag force associated with the inner radial speed component carries the large particles towards the outside of the vortex, and thus the fine particles are recovered to the inside and are discharged through the duct 9.

On the other hand, coarse particles rotate and fall along the inner side of the guide vanes 7 and are discharged from the cone-shaped hopper 1*b* of the casing 1 to the outside. There is a pressure reduction towards the center of the classifier with the formation of the vortex. Therefore, the pressure in the discharge duct 9 for the fine powder is lower than that of the outside, where the raw material dispersion chamber is located. On the other hand, it is necessary to provide a gap for the rotation of the rotary classifying impeller 5 at the boundary portion between the discharge duct 9 and the rotary classifying impeller 5, as long as a sliding structure is not utilized. However, as mentioned above a sliding structure is unsuitable for sealing a mixture of powder and gases, and in the event of the sealing gap there is a fear that the pressure differences will cause an air flow from the raw material dispersion chamber 10 to the discharge duct 9.

In the leakage prevention apparatus 20 for a classifier of the present invention, the rotary seal member 21 on the upper plate 5*a* of the rotary classifying impeller 5 is mounted at the boundary portion between the rotary classifying impeller 5 and the discharge duct 9, with the upper portion 22 of the seal member 21 protruding outwardly from the opening 12 of the top plate 11 of the casing 1 to perfectly separate the reduced air pressure of the discharge duct 9 from the high pressure in the raw material dispersion chamber 10 and to prevent air flow directed from the raw material dispersion chamber 10 through the boundary portion to the discharge duct 9. The leakage prevention apparatus is also adjusted to supply a very small amount of air flow from the gap between the opening 12 of the top plate 11 of the casing 1 and the rotary seal member 21 into the discharge duct side to rinse the groove portion. Furthermore, in the embodiments of the present invention, outside air is sucked from the opening 12 into the radially outward side of the seal, that is the raw material dispersion chamber 10 so that the leakage from the material dispersion chamber 10 into the discharge duct 9 can be positively prevented. On the other hand, the rotary seal member can be formed in a J-shaped cross-sectional construction so that classified fine particles effected by the centrifugal force will not be puffed out of the casing resulting in environmental pollution.

Furthermore, the leakage prevention apparatus for the classifier of the present invention is particularly effective in classifying such materials as fine ceramics where noticeable losses in quality occur from the mixing in of the coarse particles. The present apparatus can perfectly prevent the leakage of the coarse particles without the necessity of other supplemental facilities.

Although the embodiments were described for classifiers with the material inlet at the top of the casing, the method of supplying the material is not restricted thereto, and the present invention can be applied to classifiers where the material is supplied from the side or the bottom of the casing.

What is claimed is:

1. A leakage prevention apparatus for a classifier having a casing which defines an outlet a first inlet, through which said casing receives air and a second inlet through which said casing receives raw material, said classifier also having a rotary classifying impeller disposed in the casing for dispersing the raw material which the casing receives and for moving a fine powder component of the raw material and discharging said fine powder component through said outlet, said apparatus comprising:

a rotary seal member mounted on the rotary classifying impeller; and a fine powder discharge duct in communication with said outlet of said casing for receiving the fine powder component of the raw material which discharges from the casing, said duct and the portion of the casing disposed around said outlet defining an opening;

said seal member including one end portion secured to the impeller and a second distal end disposed outwardly of the impeller, said second end extending into said opening between said casing and said duct and closing a substantial portion of said opening to prevent leakage of the coarse material into the duct.

2. The leakage prevention apparatus of claim 1 in which the opening of the top plate of the casing is circular.

3. The leakage prevention apparatus of claim 1 wherein said second distal end portion includes a first segment which extends into said opening, a second segment spaced from said first segment and a groove disposed between the first and second segments.

4. The leakage prevention apparatus of claim 3 wherein said groove receives an end portion of said discharge duct.

5. The leakage prevention apparatus of claim 3 wherein said second segment has a generally rounded configuration.

6. The leakage prevention apparatus of claim 3 wherein said second segment has a generally rectangular cross-section.

7. The leakage prevention apparatus of claim 3 wherein said inner end includes a surface disposed opposite said groove and at an acute angle to the longitudinal axis of said seal member.

* * * * *